US010393072B2

(12) United States Patent
Segawa

(10) Patent No.: US 10,393,072 B2
(45) Date of Patent: Aug. 27, 2019

(54) INTERNAL COMBUSTION ENGINE

(71) Applicant: TOYOTA JIDOSHA KABUSHIKI KAISHA, Toyota-shi, Aichi (JP)

(72) Inventor: Taku Segawa, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 159 days.

(21) Appl. No.: 15/112,837

(22) PCT Filed: Jan. 16, 2015

(86) PCT No.: PCT/JP2015/051748
§ 371 (c)(1),
(2) Date: Jul. 20, 2016

(87) PCT Pub. No.: WO2015/111679
PCT Pub. Date: Jul. 30, 2015

(65) Prior Publication Data

US 2017/0002773 A1 Jan. 5, 2017

(30) Foreign Application Priority Data

Jan. 22, 2014 (JP) ..... 2014-009578

(51) Int. Cl.
*F02M 26/35* (2016.01)
*F02M 35/10* (2006.01)
(Continued)

(52) U.S. Cl.
CPC ..... *F02M 26/35* (2016.02); *F02B 29/02* (2013.01); *F02B 33/40* (2013.01); *F02B 37/00* (2013.01);
(Continued)

(58) Field of Classification Search
CPC ..... F02M 26/35; F02M 26/06; F02M 26/09; F02M 26/17; F02M 35/10222;
(Continued)

(56) References Cited

U.S. PATENT DOCUMENTS 3,781,126 A * 12/1973 Benisek ..... F02B 29/0481 415/143
5,295,785 A * 3/1994 Church ..... F04D 29/4213 415/58.4
(Continued)

FOREIGN PATENT DOCUMENTS

JP 07310691 A * 11/1995
JP 2003035153 A * 2/2003
(Continued)

*Primary Examiner* — Thai Ba Trieu
(74) *Attorney, Agent, or Firm* — Hunton Andrews Kurth LLP

(57) ABSTRACT

The internal combustion engine includes a compressor for supercharging intake air, an EGR device for introducing EGR gas into an intake passage at a position on an upstream side relative to the compressor, and a collecting pocket that is provided at an outer circumference of a compressor inlet and that collects condensed water generated inside the intake passage on an upstream side relative to the compressor. The collecting pocket opens towards the upstream side of the compressor, and is formed in a circular ring shape that surrounds the outer circumference of the compressor inlet. The collecting pocket includes a partition wall that holds back a flow of condensed water that attempts to move in a downward gravitational direction inside an internal space of the collecting pocket.

8 Claims, 5 Drawing Sheets

(51) Int. Cl.

| | |
|---|---|
| ***F02B 33/40*** | (2006.01) |
| ***F02B 39/00*** | (2006.01) |
| ***F02M 26/06*** | (2016.01) |
| ***F02M 26/09*** | (2016.01) |
| ***F02M 26/17*** | (2016.01) |
| ***F02B 29/02*** | (2006.01) |
| ***F02B 37/00*** | (2006.01) |
| ***F02M 35/08*** | (2006.01) |
| *F02B 29/04* | (2006.01) |

(52) U.S. Cl.
CPC ..... *F02B 39/005* (2013.01); *F02M 26/06* (2016.02); *F02M 26/09* (2016.02); *F02M 26/17* (2016.02); *F02M 35/088* (2013.01); *F02M 35/10222* (2013.01); *F02B 29/0468* (2013.01)

(58) Field of Classification Search
CPC ..... F02M 35/088; F02B 9/02; F02B 29/0468; F02B 33/40; F02B 37/00; F02B 37/16; F02B 39/005
USPC ..... 60/605.2, 605.1, 611; 415/206, 57.1, 415/57.3, 57.4, 58.3, 58.4; 417/407–409
See application file for complete search history.

(56) References Cited

U.S. PATENT DOCUMENTS

| | | | | |
|---|---|---|---|---|
| 5,399,064 | A * | 3/1995 | Church | F04D 29/4213 415/58.4 |
| 5,863,178 | A * | 1/1999 | Scheinert | F04D 29/4213 415/58.4 |
| 6,196,789 | B1 * | 3/2001 | McEwen | F04D 29/4213 415/58.4 |
| 6,726,441 | B2 * | 4/2004 | Sumser | F04D 29/4213 415/58.3 |
| 7,946,118 | B2 * | 5/2011 | Hippen | F01M 11/02 417/407 |
| 8,056,338 | B2 * | 11/2011 | Joergl | F02M 26/06 60/605.2 |
| 8,272,832 | B2 * | 9/2012 | Yin | F04D 29/4213 415/58.4 |
| 8,365,526 | B2 * | 2/2013 | Stiermann | F02B 39/005 60/599 |
| 8,888,440 | B2 * | 11/2014 | Tomita | F04D 29/4213 415/57.1 |
| 9,951,793 | B2 * | 4/2018 | Lucas | F01D 5/02 |
| 2002/0029570 | A1 * | 3/2002 | Baeuerle | F02B 39/005 417/407 |
| 2011/0011084 | A1 | 1/2011 | Yanagida et al. | |
| 2012/0121400 | A1 * | 5/2012 | Tomita | F04D 27/023 415/206 |
| 2012/0321455 | A1 * | 12/2012 | Boening | F04D 25/024 415/208.1 |
| 2013/0266436 | A1 * | 10/2013 | Ibaraki | F02M 26/05 415/208.1 |
| 2014/0224232 | A1 | 8/2014 | Hotta | |
| 2014/0366533 | A1 * | 12/2014 | Shioda | F02M 26/09 60/605.2 |
| 2015/0176429 | A1 * | 6/2015 | Oki | F02B 39/005 415/175 |
| 2016/0108802 | A1 * | 4/2016 | Smiljanovski | F02M 26/06 60/605.2 |
| 2016/0273548 | A1 * | 9/2016 | Uesugi | F04D 29/4206 |
| 2016/0273551 | A1 * | 9/2016 | Uesugi | F02B 39/005 |

FOREIGN PATENT DOCUMENTS

| | | | |
|---|---|---|---|
| JP | 2011-032880 | A | 2/2011 |
| JP | 2013-029081 | A | 2/2013 |
| KR | 1020120093024 | A * | 8/2012 |
| WO | 2013/065112 | A1 | 5/2013 |

* cited by examiner (A)

(B)

INTERNAL COMBUSTION ENGINE

CROSS-REFERENCE TO RELATED APPLICATIONS

This is a national phase application based on the PCT International Patent Application No. PCT/JP2015/051748 filed Jan. 16, 2015, claiming priority to Japanese Patent Application No. 2014-009578 filed Jan. 22, 2014, the entire contents of both of which are incorporated herein by reference.

TECHNICAL FIELD

The present invention relates to an internal combustion engine, and more particularly to an internal combustion engine with a supercharger for supercharging intake air.

BACKGROUND ART

A conventional EGR device for an internal combustion engine is disclosed in, for example, Patent Literature 1. The aforementioned conventional EGR device includes a condensed water collecting portion in an EGR passage. More specifically, the condensed water collecting portion collects condensed water generated from EGR gas at a concavo-convex portion provided in an inner wall of the EGR passage at a position that is on a downstream side of the EGR gas flow relative to an EGR cooler. The condensed water collected by the condensed water collecting portion is received into a reservoir portion connected to the EGR passage and is stored therein.

CITATION LIST

Patent Literature

[Patent Literature 1] Japanese Patent Laid-Open No. 2013-029081

SUMMARY OF INVENTION

Technical Problem

In the reservoir portion for condensed water described in Patent Literature 1, although the existence of a passage and a valve for discharging condensed water is illustrated in the accompanying drawings, a method for processing the condensed water is not explicitly described. Further, in an internal combustion engine having a configuration in which EGR gas is introduced to an intake passage at a position that is further on an upstream side relative to a compressor that supercharges intake air, condensed water can also be generated after the EGR gas merges with fresh air. In particular, there is a concern that erosion will occur if condensed water which was formed on the wall surface of the intake passage strikes against an outer circumferential portion (portion at which the circumferential speed is highest) of a compressor impeller in the form of large-sized droplets. This problem is noticeable in an internal combustion engine in which introduction of a large amount of EGR gas is performed to improve fuel consumption, since condensed water is more liable to be generated. Accordingly, in an internal combustion engine having a configuration that introduces EGR gas into an intake passage at a position on an upstream side relative to a compressor, it is desirable that the configuration is capable of suppressing an inflow of condensed water as it is in droplet form into the compressor.

The present invention has been conceived to solve the above-described problem, and an object of the present invention is to provide an internal combustion engine in which EGR gas is introduced into an intake passage at a position that is on an upstream side relative to a compressor that supercharges intake air, and which is configured to enable the suppression of an inflow of condensed water as it is in droplet form into the compressor.

Solution to Problem

A first invention is an internal combustion engine, including:

a compressor for supercharging intake air;

an EGR device for introducing EGR gas into an intake passage on an upstream side relative to the compressor; and a collecting pocket that is provided at an outer circumference of an inlet of the compressor, and that collects condensed water that is generated inside the intake passage on the upstream side relative to the compressor;

wherein:

the collecting pocket opens towards the upstream side of the compressor, and is formed in a ring shape that surrounds the outer circumference of the inlet of the compressor; and the collecting pocket includes at least one partition wall that holds back a flow of condensed water that attempts to move in a downward gravitational direction inside an internal space of the collecting pocket.

A second invention is in accordance with the first invention, wherein:

an inner wall of the intake passage that is positioned directly above a flow of intake air to the collecting pocket covers a portion of the collecting pocket in a radial direction of the inlet of the compressor.

Further, a third invention is in accordance with the first or second invention, wherein:

in a circumferential wall surface that becomes a downward side in a gravitational direction among wall surfaces of a cell of the collecting pocket that is partitioned by the partition wall, in comparison to an area on an inlet side of the collecting pocket, an area on an innermost side is located at a lower position in the gravitational direction.

A fourth invention is in accordance with any one of the first to third inventions, further including:

a cooling water passage through which cooling water flows that cools a housing forming the compressor; and a flow rate adjusting device for adjusting a cooling water flow rate in the cooling water passage.

Further, a fifth invention is in accordance with the fourth invention, wherein:

in a case in which condensed water is generated in a downstream-side intake passage that is on a downstream side relative to a portion for introducing EGR gas by means of the EGR device in the intake passage and in which a wall surface temperature of the collecting pocket is equal to or less than a predetermined value, the flow rate adjusting device is controlled so as to restrict the cooling water flow rate in the cooling water passage.

A sixth invention is in accordance with the fifth invention, wherein:

the predetermined value relating to the wall surface temperature of the collecting pocket is a boiling temperature of condensed water that is generated in the downstream-side intake passage.

A seventh invention is in accordance with any one of the first to sixth inventions, wherein:

the partition wall is formed inside the collecting pocket so as to extend radially from a center of the inlet of the compressor in a radial direction of the inlet.

Further, an eight invention is in accordance with any one of the first to sixth inventions, wherein:

the partition wall is formed inside the collecting pocket so as to extend in a gravitational direction.

Advantageous Effects of Invention

According to the first invention, condensed water that is generated in an intake passage at a position on an upstream side relative to a compressor and travels along a wall surface of the intake passage to flow to the downstream side can be collected by means of a collecting pocket provided at the outer circumference of an inlet of the compressor. Further, water inside the collecting pocket can be dispersed by means of a partition wall provided in the collecting pocket. A housing that is included in the compressor receives heat from gas that is compressed by the compressor, and in accompaniment therewith the collecting pocket including the partition wall receives heat from the housing. By utilizing the received heat, the collecting pocket can be heated to evaporate condensed water in the collecting pocket without requiring a special heat source. Therefore, according to the present invention, the occurrence of a situation in which condensed water flows as it is in droplet form into the compressor can be suppressed. Further, condensed water that evaporated inside the collecting pocket is processed by being drawn into the compressor together with intake air. Consequently, a special measure for draining condensed water which accumulated inside the collecting pocket is not required.

According to the second invention, at an area on a lower side in the gravitational direction in the collecting pocket, condensed water which has accumulated in the collecting pocket can be prevented from flowing out to the upstream side of the compressor.

According to the third invention, condensed water which has accumulated in the collecting pocket can be prevented from flowing out to the upstream side of the compressor.

According to the fourth invention, since a cooling water passage is provided for cooling the housing that is included in the compressor, the accumulation of deposits in a gas passage inside the compressor can be prevented by cooling so that the temperature of the housing does not become too high. On the other hand, from the viewpoint of promoting vaporization of condensed water inside the collecting pocket, it is preferable that the temperature of the housing is high. According to the present invention, in addition to providing the aforementioned cooling water passage, by also providing a flow rate adjusting device for adjusting the flow rate of cooling water in the cooling water passage, a configuration can be obtained which makes it possible to both prevent the accumulation of deposits and also promote vaporization of condensed water inside the collecting pocket in a compatible manner.

According to the fifth invention, under circumstances in which it is assumed that the temperature of the aforementioned housing is higher than the cooling water temperature, a decrease in the temperature of the collecting pocket can be suppressed by restricting the cooling water flow rate. It is thereby possible to suppress a decrease in the effect of a function for heating the collecting pocket utilizing heat received from the housing under circumstances in which condensed water is being generated, while also securing a function for cooling the housing by circulation of cooling water.

According to the sixth invention, circumstances in which a decrease in the effect of the function for heating the collecting pocket should be suppressed by restricting the cooling water flow rate can be suitably determined.

According to the seventh and eighth inventions, the partition wall can be utilized to suitably disperse and store condensed water inside the collecting pocket.

DESCRIPTION OF EMBODIMENTS

Embodiment 1

Figure 1:
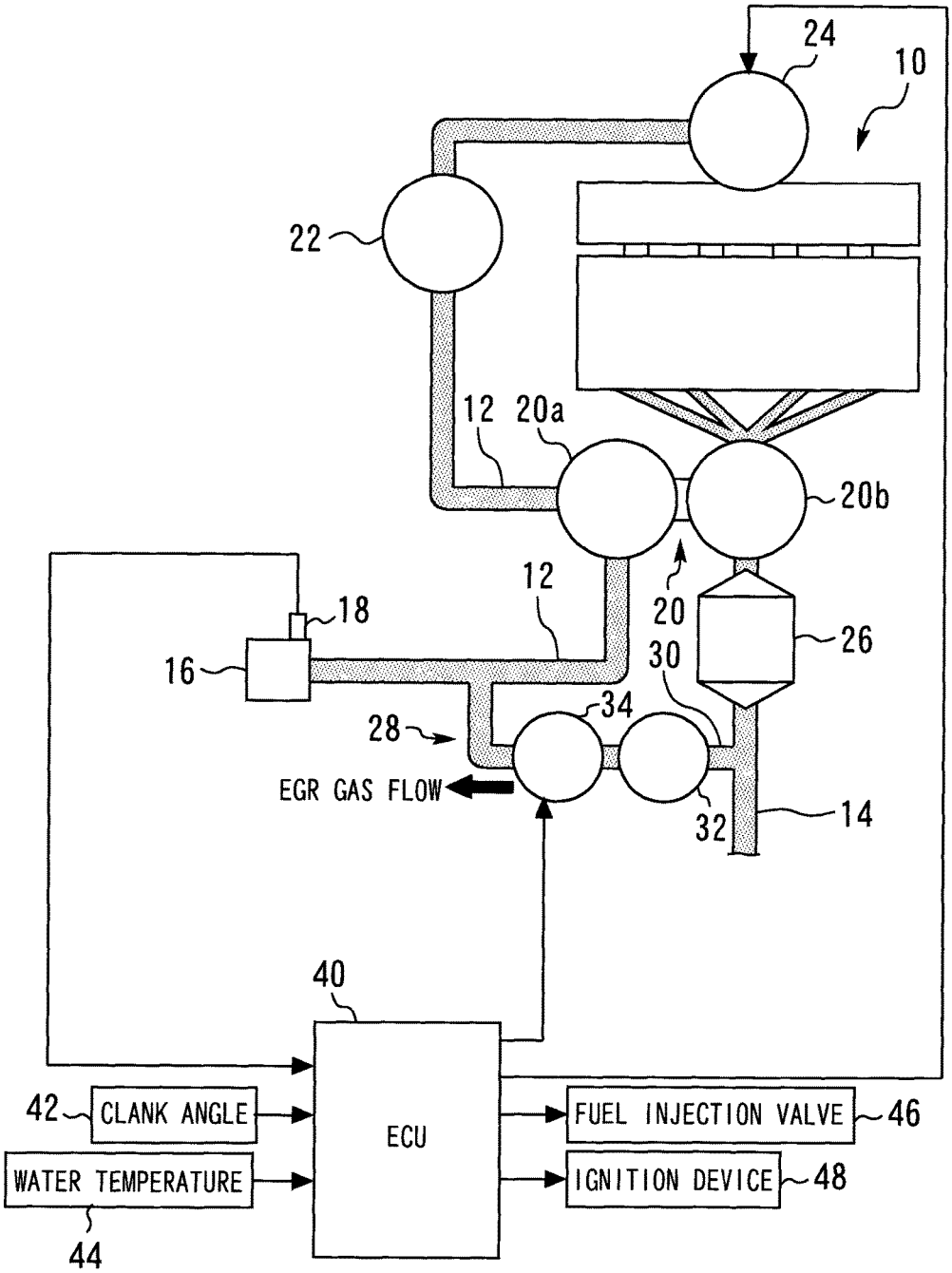
FIG. 1 is a view for describing the system configuration of an internal combustion engine of Embodiment 1 of the present invention.

FIG. 1 is a view for describing the system configuration of an internal combustion engine 10 of Embodiment 1 of the present invention. A system of the present embodiment includes the internal combustion engine (as one example, a spark-ignition type gasoline engine) 10. An intake passage 12 and an exhaust passage 14 communicate with each cylinder of the internal combustion engine 10.

An air cleaner 16 is installed in the vicinity of an inlet of the intake passage 12. An air flow meter 18 that outputs a signal in accordance with a flow rate of air that is drawn into the intake passage 12 is provided in the air cleaner 16. A compressor 20*a* of a turbo-supercharger 20 is arranged downstream of the air cleaner 16. The compressor 20*a* is a centrifugal-type compressor, and is integrally connected through a connecting shaft 20*c* (see FIG. 2) with a turbine 20*b* arranged in the exhaust passage 14. The configuration around the inlet of the compressor 20*a* is a characteristic portion of the present embodiment, and hence the configuration around the inlet will be described in detail later referring to FIG. 2 and FIG. 3.

An intercooler 22 for cooling air that was compressed by the compressor 20*a* is provided downstream of the compressor 20*a*. An electronically controlled throttle valve 24 is provided downstream of the intercooler 22.

An exhaust purification catalyst (in this case, a three-way catalyst) 26 is arranged in the exhaust passage 14 at a position that is further downstream than the turbine 20*b*. The internal combustion engine 10 illustrated in FIG. 1 also includes a low-pressure loop (LPL) type EGR device 28.

The EGR device 28 includes an EGR passage 30 that connects the exhaust passage 14 on the downstream side of the exhaust purification catalyst 26 with the intake passage 12 on the upstream side of the compressor 20*a*. An EGR cooler 32 and an EGR valve 34 are respectively provided partway along the EGR passage 30 in that order from the upstream side of the flow of EGR gas when the EGR gas is introduced into the intake passage 12. The EGR cooler 32 is provided for cooling EGR gas that flows through the EGR passage 30. The EGR valve 34 is provided for regulating the amount of EGR gas that passes through the EGR passage 30 and recirculates to the intake passage 12.

The system illustrated in FIG. 1 also includes an ECU (electronic control unit) 40. In addition to the aforementioned air flow meter 18, various sensors for detecting the operating state of the internal combustion engine 10 such as a crank angle sensor 42 for detecting engine speed (i.e. engine revolution speed) are electrically connected to an input portion of the ECU 40. Further, a cooling water temperature sensor 44 for detecting the temperature of cooling water that cools the engine body is also electrically connected to the input portion of the ECU 40. In addition to the aforementioned throttle valve 24 and EGR valve 34, various actuators for controlling operations of the internal combustion engine 10 such as a fuel injection valve 46 for supplying fuel to the internal combustion engine 10 and an ignition device 48 for igniting an air-fuel mixture in the cylinders are electrically connected to an output portion of the ECU 40. The ECU 40 controls the operations of the internal combustion engine 10 by actuating the various actuators in accordance with the output of the various sensors described above and a predetermined program.

In an internal combustion engine having a configuration in which EGR gas is introduced to an intake passage at a position on the upstream side relative to a compressor that supercharges intake air, as in the configuration of the internal combustion engine 10 of the present embodiment, condensed water may be generated when the EGR gas merges with fresh air. In particular, there is a concern that erosion will occur if condensed water which was formed on the wall surface of the intake passage strikes against an outer circumferential portion (portion at which the circumferential speed is highest) of the compressor impeller in the form of large-sized droplets. This problem is noticeable in an internal combustion engine, such as the internal combustion engine 10, in which introduction of a large amount of EGR gas is performed to improve fuel consumption, since condensed water is more liable to be generated.

Figure 2:
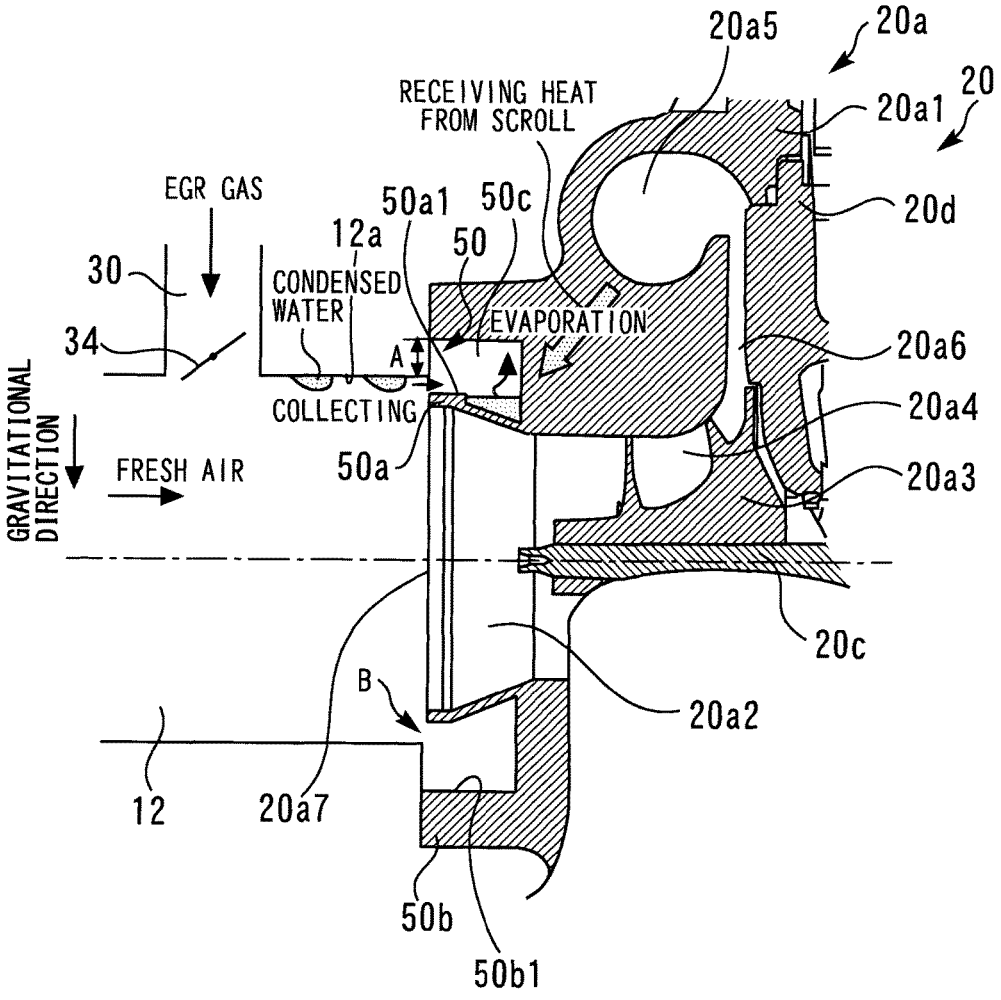
FIG. 2 is a sectional view illustrating a diagrammatic representation of a characteristic configuration around an inlet of a compressor in Embodiment 1 of the present invention.

FIG. 2 is a sectional view illustrating a diagrammatic representation of a characteristic configuration around the inlet of the compressor 20*a* in Embodiment 1 of the present invention. In the present embodiment, to solve the above described problem, a configuration is adopted in which a collecting pocket 50 for collecting condensed water is provided in a compressor inlet portion 20*a*2.

First, the basic configuration of the compressor 20*a* will be described in brief. The compressor 20*a* is provided partway along the intake passage 12, and the inside thereof functions as one part of the intake passage 12. As shown in FIG. 2, the turbo-supercharger 20 includes, as housings around the compressor 20*a*, a compressor housing 20*a*1, and a bearing housing 20*d* that is a housing that is combined with the compressor housing 20*a*1 and has a function of supporting a connecting shaft 20*c*. The compressor inlet portion 20*a*2 that is connected to the intake passage 12 immediately above the compressor 20*a*, an impeller portion 20*a*4 that houses a compressor impeller 20*a*3 that is fixed to the connecting shaft 20*c*, and a spiral-shaped scroll portion 20*a*5 are formed in the compressor housing 20*a*1. A diffuser portion 20*a*6 is also provided as an area that is formed by the compressor housing 20*a*1 and the bearing housing 20*d*. The diffuser portion 20*a*6 is a disc-shaped passage located at a position that is further on the outer circumferential side than the impeller portion 20*a*4 and is between the impeller portion 20*a*4 and the scroll portion 20*a*5.

The configuration is such that gas that is drawn into the compressor 20*a* from the compressor inlet portion 20*a*2 is pressurized when passing through the impeller portion 20*a*4 and the diffuser portion 20*a*6, and is discharged to the intake passage 12 on the downstream side of the compressor 20*a* through the scroll portion 20*a*5.

Next, the configuration of the collecting pocket 50 will be described referring to FIG. 2 and FIG. 3.

As shown in FIG. 2, in order to collect condensed water generated inside the intake passage 12 on the upstream side relative to the compressor 20*a*, the collecting pocket 50 is provided at the outer circumference of a compressor inlet 20*a*7 in the compressor inlet portion 20*a*2. The collecting pocket 50 opens towards the upstream side of the compressor 20*a*, and is formed in a ring shape (in the present embodiment, a circular ring shape) that surrounds the outer circumference of the compressor inlet 20*a*7.

In the example illustrated in FIG. 2, the collecting pocket 50 is formed in the compressor housing 20*a*1 that forms the compressor inlet portion 20*a*2. However, the collecting pocket 50 may be a member that, as a separate member to the compressor housing 20*a*1, is interposed between the compressor housing 20*a*1 and an intake pipe constituting the intake passage 12 on the upstream side of the compressor 20*a*. However, the thermal conductivity from the scroll portion 20*a*5 is better when the collecting pocket 50 is formed integrally with the compressor housing 20*a*1, and accordingly the integrated configuration is preferable from the viewpoint of promoting evaporation of condensed water inside the collecting pocket 50 that is described later.

Figure 3:
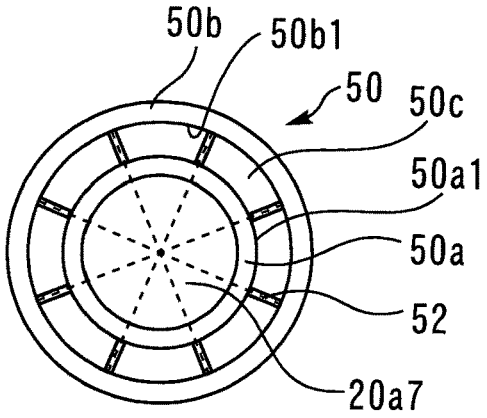
FIG. 3 is a view showing a collecting pocket as seen from an upstream side of the compressor inlet.

FIG. 3 is a view showing the collecting pocket 50 as seen from the upstream side of the compressor inlet 20*a*7. As shown in FIGS. 2 and 3, the collecting pocket 50 includes an inner circumferential wall portion 50*a* and an outer circumferential wall portion 50*b*. The inner circumferential wall portion 50*a* constitutes the outer circumference of the compressor inlet 20*a*7. The outer circumferential wall portion 50*b* constitutes the outer circumference of the collecting pocket 50, and has an inside circumferential wall surface 50*b*1 that faces an inside circumferential wall surface 50*a*1 of the inner circumferential wall portion 50*a* in a manner which sandwiches the internal space of the collecting pocket 50 therebetween.

A plurality of plate-shaped partition walls 52 that hold back the flow of condensed water that attempts to move downward in the gravitational direction within the internal space of the collecting pocket 50 are formed in the collecting pocket 50. In the example shown in FIG. 3, the plurality of partition walls 52 are formed to extend radially in all directions, i.e. eight directions, from the center of the compressor inlet 20*a*7. More specifically, each of the partition walls 52 is formed so as to connect the inside circumferential wall surface 50*a*1 and the inside circumferential wall surface 50*b*1. A plurality of cells 50*c* are defined in the internal space of the collecting pocket 50 by the plurality of partition walls 52. The capacity of each cell 50*c* of the collecting pocket 50 and the number of the partition walls 52 are set by taking into account the assumed amount of condensed water that will be generated.

The compressor housing 20*a*1 is formed of a common metal (in this case, as one example, an aluminum alloy). Accordingly, the material of the collecting pocket 50 and the partition walls 52 formed in the compressor housing 20*a*1 is the same metal as the compressor housing 20*a*1. Therefore, the collecting pocket 50 and partition walls 52 have excellent thermal conductivity with respect to the transfer of heat from the compressor housing 20*a*1.

Further, as shown in FIG. 2, an inner wall 12*a* of the intake passage 12 that is positioned directly above the flow of intake air to the collecting pocket 50 covers a part of the collecting pocket 50 in the radial direction of the compressor inlet 20*a*7. That is, the radius of the inner wall 12*a* is made smaller than the radius of the inside circumferential wall surface 50*b*1 of the outer circumferential wall portion 50*b* by an overlap amount A shown in FIG. 2. Note that, to ensure that condensed water can travel along the inner wall 12*a* of the intake passage 12 and flow into the respective cells 50*c* of the collecting pocket 50, the size of the overlap amount A is set so that an area that opens towards the upstream side of the compressor 20*a* can be secured in the respective cells 50*c*. Further, to facilitate the flow of condensed water into the respective cells 50*c*, a B portion of the inner wall 12*a* (see FIG. 2) may be chamfered.

In a case where the partition walls 52 are formed in a radial shape as shown in FIG. 3, in the cells 50*c* located in the lower half area in the gravitational direction in the collecting pocket 50, the partition walls 52 incline so that the outer circumferential wall portion 50*b* side is the lower part thereof. As a result, condensed water collected inside the cells 50*c* flows to the outer circumferential wall portion 50*b* side and is accumulated in the vicinity of the outer circumferential wall portion 50*b* until the condensed water evaporates. By causing the inner wall 12*a* of the intake passage 12 to overlap as described above at the front face of each cell 50*c*, condensed water accumulated inside the cells 50*c* located in the lower half area in the gravitational direction can be held back so as not to flow out to the upstream side of the compressor 20*a*.

On the other hand, in the cells 50*c* located in the upper half area in the gravitational direction in the collecting pocket 50, the partition walls 52 incline so that the inner circumferential wall portion 50*a* side is the lower part thereof. As a result, condensed water collected inside the cells 50*c* flows to the inner circumferential wall portion 50*a* side and is accumulated in the vicinity of the inner circumferential wall portion 50*a* until the condensed water evaporates. Therefore, in the upper half area in the gravitational direction in the collecting pocket 50, the inside circumferential wall surface 50*a*1 of the inner circumferential wall portion 50*a* is formed in a stepped shape so that, as shown in FIG. 2, an area on the innermost side is located at a lower position in the gravitational direction than an area on the inlet side of the collecting pocket 50. As a result, condensed water accumulated inside the cells 50*c* located in the upper half area in the gravitational direction can be held back so as not to flow out to the upstream side of the compressor 20*a*.

Note that, in the example illustrated in FIG. 2, the inside circumferential wall surface 50*a*1 of the inner circumferential wall portion 50*a* on the upper half side in the gravitational direction, as one example, drops downward in the gravitational direction in a step shape at a position that located at a predetermined length towards the innermost side from the inlet, and thereafter inclines so as to be at a progressively lower position in the gravitational direction in accordance with the proximity thereof to the innermost side. However, it is sufficient that the shape of the inside circumferential wall surface 50*a*1 is designed taking into consideration a measure for suppressing an outflow of condensed water to the upstream side of the compressor 20*a*. That is, for example, an area after a region that is partway along the inside circumferential wall surface 50*a*1 that drops downward in a step shape may be formed so as to be flat in the gravitational direction, or may be a surface that is not formed in a stepped shape but is instead sloped so as to descend uniformly towards the innermost side from the inlet side.

By providing the collecting pocket 50 as described above, condensed water can be collected inside each cell 50*c* by utilizing an inertial force of condensed water that adheres to the inner wall 12*a* of the intake passage 12 and is caused to flow to the downstream side by the flow of intake air. The temperature of each wall surface of the collecting pocket 50 reaches a high temperature as a result of receiving heat from the scroll portion 20*a*5 whose temperature is increased to a high temperature by the compressed air. Consequently, condensed water collected inside each cell 50*c* can be evaporated without requiring a special heat source for heating the collecting pocket 50. More specifically, the condensed water vaporizes after being accumulated inside the cells 50*c*, or depending on the temperature of the wall surface of the cells 50*c*, immediately vaporizes when the condensed water contacts the wall surface. The vaporized condensed water is processed by being taken into the compressor 20*a* together with the intake air. Consequently, a special measure for draining accumulated condensed water is not required. As described above, according to the configuration of the present embodiment, since an inflow of generated condensed water as it is in droplet form into the compressor 20*a* can be suppressed, erosion of the compressor impeller 20*a*3 can be prevented. As a result, operational restrictions (restrictions on introduction of EGR gas at the time of a low outside air temperature or the like) that are due to measures for preventing erosion can be avoided.

Further, the collecting pocket 50 is partitioned (divided) into the plurality of cells 50*c* by the plurality of partition walls 52. As a result, similarly to the collecting pocket 50 and the respective wall surfaces, by also utilizing the partition walls 52 that become a high temperature as a result of receiving heat from the scroll portion 20*a*5, the area of contact between the condensed water and the wall surfaces can be increased and the condensed water can be thereby prevented from accumulating at one place at the lower part in the gravitational direction of the collecting pocket 50. Thus, evaporation of the condensed water can be promoted. Furthermore, if the amount of EGR gas that is introduced into an engine is small, since the generated amount of condensed water is small, it can be considered sufficient to accumulate the condensed water at one place at a lower part in the gravitational direction. In contrast, in a case where a large amount of EGR gas is introduced, such as in the internal combustion engine 10, mixing of fresh air and EGR gas is promoted, and a large amount of condensed water is liable to be generated across the entire area in the circumferential direction of the inner wall 12*a* of the intake passage 12. Even in such a case, by partitioning the collecting pocket 50 using the plurality of partition walls 52, condensed water generated across the entire area in the circumferential direction can be collected with the respective cells 50*c*. Further, because condensed water can be dispersed to the respective cells 50*c* and accumulated therein, and the area of contact is also increased as described above, in comparison to a case where the condensed water is accumulated at one place, it is possible to make it more difficult for condensed water to spill out from the areas where the condensed water has accumulated.

The foregoing Embodiment 1 was described by taking the collecting pocket 50 including the plurality of partition walls 52 that are formed so as to radially extend in all directions from the center of the compressor inlet 20*a*7 as one example. However, it is sufficient that the collecting pocket according to the present invention includes at least one partition wall that holds back the flow of condensed water that attempts to move downward in the gravitational direction inside the internal space of the collecting pocket. Even in a case where, for example, the collecting pocket includes only one partition wall that extends directly downward in the gravitational direction towards the outer circumferential wall portion from the lowermost end position of the inner circumferential wall portion of the collecting pocket, condensed water that attempts to move downward in the gravitational direction inside the collecting pocket can be split into the left and right sides and held back. This configuration also has the effect of promoting the evaporation of condensed water that comes in contact with the partition wall. Accordingly, a partition wall having such a form can also be included in the present invention. However, a configuration that includes only one partition wall that extends directly upward in the gravitational direction towards the outer circumferential wall portion from the uppermost end position of the inner circumferential wall portion of the collecting pocket is not included in the present invention. This is because a partition wall having such a form does not have a function that holds back a flow of condensed water that attempts to move downward in the gravitational direction inside the internal space. Furthermore, in addition to the example illustrated in FIG. 3, for example, a configuration illustrated in FIG. 4 that is described hereunder can also be mentioned as a specific configuration example of a partition wall.

Figure 4:
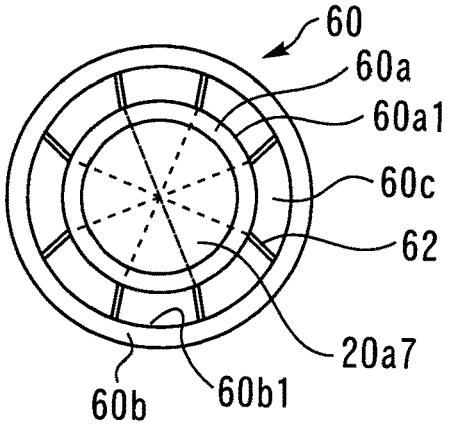
FIG. 4 is a view that diagrammatically represents another configuration example of a collecting pocket that is an object of the present invention.
Figure 4:
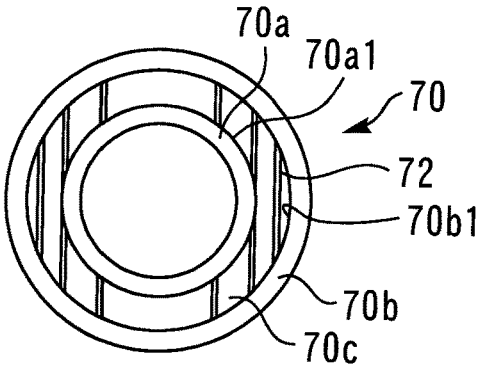

FIG. 4 is a view that diagrammatically represents another configuration example of a collecting pocket that is an object of the present invention. A plurality of partition walls 62 included in a collecting pocket 60 shown in FIG. 4(A) are arranged at uniform positions in the circumferential direction of the collecting pocket 60 as connecting positions to an inner circumferential wall portion 60*a*, and are similar to the example illustrated in FIG. 3 in which the partition walls 52 are provided so as to extend radially. A difference with respect to the example illustrated in FIG. 3 is that, a configuration is adopted so that, at an area on a side at which condensed water accumulates (the inner circumferential wall portion 60*a* side with respect to the upper half side in the gravitational direction in the collecting pocket 60, and an outer circumferential wall portion 60*b* side with respect to the lower half side in the gravitational direction), an angle between the partition walls 62 and an inside circumferential wall surface 60*a*1 or 60*b*1 is a sharp angle with respect to radial reference lines that center on the compressor inlet 20*a*7.

On the other hand, a plurality of partition walls 72 that a collecting pocket 70 shown in FIG. 4(B) includes are plate-like walls that are formed so as to extend in the gravitational direction. The intervals between the plurality of partition walls 72 may be fixed or may be irregular. Unlike the examples of the partition walls 52 and 62, the partition walls 72 formed in this manner are not only walls that connect an inside circumferential wall surface 70*a*1 of the inner circumferential wall portion 70*a* and an inside circumferential wall surface 70*b*1 of the outer circumferential wall portion 70*b*, but also, as shown in FIG. 4(B), include walls that connect together areas of the inside circumferential wall surface 70*b*1 of the outer circumferential wall portion 70*b*. In the example illustrated in FIG. 4(B) also, an angle between the partition wall 72 and the inside circumferential wall surface 70*a*1 or 70*b*1 at an area at which condensed water accumulates is a sharp angle in comparison to the example illustrated in FIG. 3.

By adopting a configuration in which the above described angles are sharp angles, in comparison to the example illustrated in FIG. 3, the amount of condensed water that can be accumulated in the respective cells 60*c* and 70*c* can be increased. Further, with respect to each example illustrated in FIG. 4 also, in order to prevent condensed water that is accumulated in the respective cells 60*c* and 70*c* from flowing out to the upstream side of the compressor 20*a*, with respect to the lower half area in the gravitational direction of the collecting pockets 60 and 70, it is favorable to adopt a configuration in which the inner wall 12*a* of the intake passage 12 overlaps with the front face of the collecting pockets 60 and 70 by the above described overlap amount A. With respect to the upper half area in the gravitational direction of the collecting pockets 60 and 70, it is favorable to provide the inside circumferential wall surfaces 60*a*1 and 70*a*1 in a stepped shape or the like, similarly to the configuration illustrated in FIG. 2. Further, it is preferable that a configuration in which the partition walls extend in the horizontal direction is not adopted in the present invention. This is because, if the partition walls are made horizontal, condensed water within the cells is liable to flow out to the upstream side of the compressor.

Further, in the above described Embodiment 1, a configuration is adopted so as to cover part of the collecting pocket 50 in the radial direction of the compressor inlet 20*a*7 by means of the inner wall 12*a* of the intake passage 12 that is positioned directly over the flow of intake air to the collecting pocket 50. However, with regard to the collecting pocket of the present invention, depending on the assumed amount of condensed water that will be generated, the above described configuration need not always be provided.

Further, in the above described Embodiment 1, in the upper half area in the gravitational direction of the collecting pocket 50, the inside circumferential wall surface 50*a*1 of the inner circumferential wall portion 50*a* is formed in a stepped shape so that, in comparison with an area on the inlet side of the collecting pocket 50 as shown in FIG. 2, an area on the innermost side is located at a lower position in the gravitational direction. In the collecting pocket 50 including the partition walls 52 that extend radially, the inside circumferential wall surface 50*a*1 of the inner circumferential wall portion 50*a* at an area on the upper half side in the gravitational direction corresponds to "a circumferential wall surface that becomes a downward side in a gravitational direction among wall surfaces of a cell of the collecting pocket that is partitioned by the partition wall". On the other hand, with respect to an area on the lower half side in the gravitational direction of the collecting pocket 50, the inside circumferential wall surface 50*b*1 of the outer circumferential wall portion 50*b* corresponds to "a circumferential wall surface that becomes a downward side in a gravitational direction among wall surfaces of a cell of the collecting pocket that is partitioned by the partition wall". Therefore, with respect to an area on the lower half side in the gravitational direction of the collecting pocket 50, instead of covering the front face of the collecting pocket 50 with the inner wall 12*a* of the intake passage 12 as in Embodiment 1, or in addition thereto, the inside circumferential wall surface 50*b*1 of the outer circumferential wall portion 50*b* may be formed in a stepped shape so that, in comparison to the area on the inlet side of the collecting pocket 50 in the configuration illustrated in FIG. 2, the area on the innermost side is located at a lower position in the gravitational direction.

Embodiment 2

Figure 5:
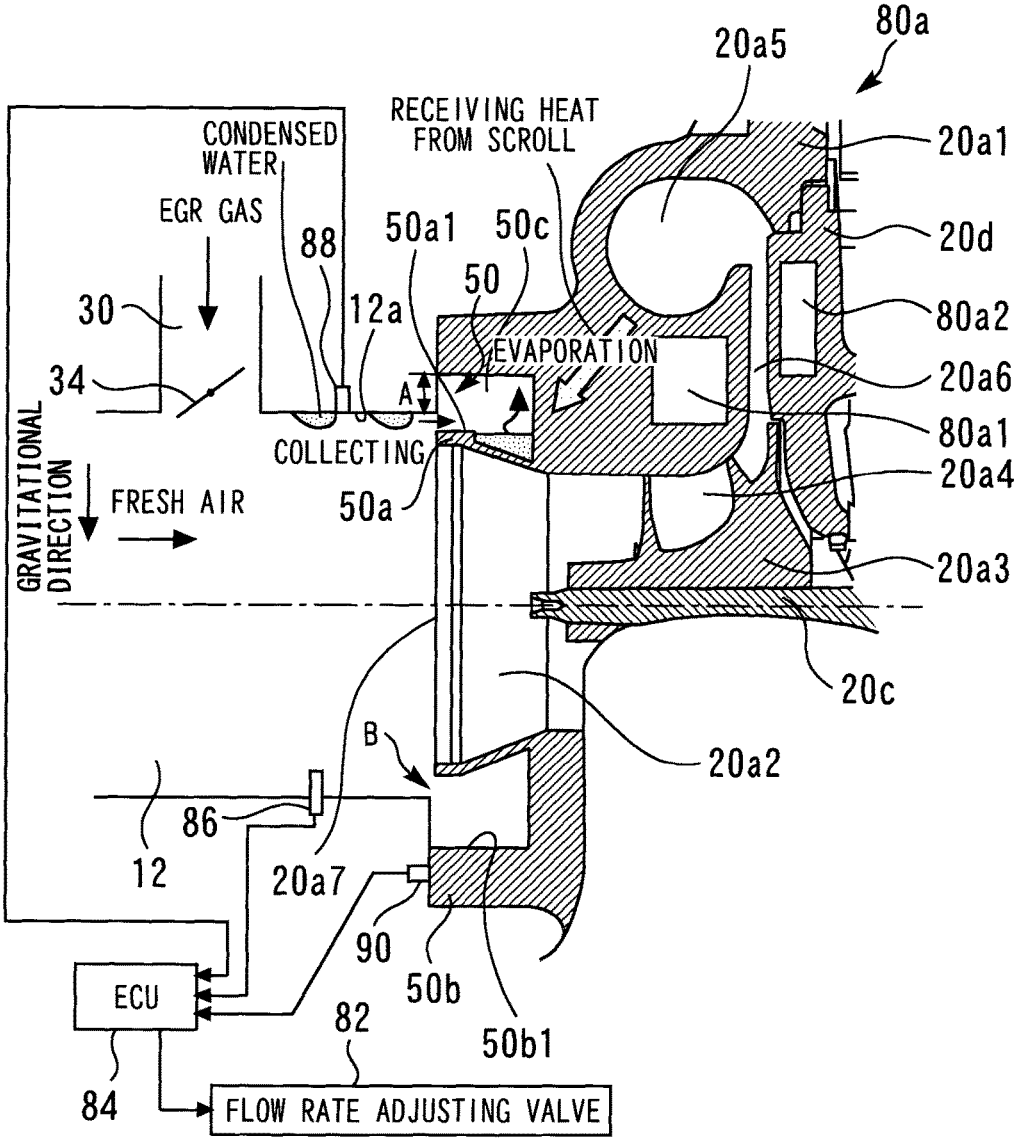
FIG. 5 is a view for describing a characteristic configuration around an inlet of a compressor in Embodiment 2 of the present invention.

Next, Embodiment 2 of the present invention will be described referring to FIG. 5 to FIG. 7. FIG. 5 is a view for describing a characteristic configuration around an inlet of a compressor 80*a* in Embodiment 2 of the present invention. Note that, in FIG. 5, elements that are the same as constituent elements illustrated in the above described FIG. 2 are denoted by the same reference symbols, and a description of those elements is omitted or simplified hereunder.

The internal combustion engine of the present embodiment has the same configuration as the above described internal combustion engine 10, except for the following difference. That is, the internal combustion engine of the present embodiment includes a compressor 80*a* instead of the compressor 20*a*. In order to cool the diffuser portion 20*a*6, the compressor 80*a* includes a first cooling water passage 80*a*1 in the compressor housing 20*a*1, and a second cooling water passage 80*a*2 in the bearing housing 20*d*. It is assumed that cooling water for cooling the engine body circulates in the aforementioned cooling water passages 80*a*1 and 80*a*2. In addition, a flow rate adjusting valve 82 for adjusting the flow rate of cooling water in the first cooling water passage 80*a*1 is provided in a cooling water passage (not shown in the drawings) that supplies cooling water to the first cooling water passage 80*a*1. Note that, to ensure that the first cooling water passage 80*a*1 does not hinder the transfer of heat to the collecting pocket 50 from the scroll portion 20*a*5 as indicated by an arrow in FIG. 5, preferably the first cooling water passage 80*a*1 that is provided in the compressor housing 20*a*1 is arranged so as not to be interposed between the scroll portion 20*a*5 and the collecting pocket 50, as in the arrangement illustrated in FIG. 5.

The system of the present embodiment includes an ECU 84 instead of the ECU 40. In addition to the same various sensors and actuators that are connected to the ECU 40, the aforementioned flow rate adjusting valve 82, a compressor-inflow-gas temperature sensor 86, an intake passage wall surface temperature sensor 88 and a pocket wall surface temperature sensor 90 are additionally connected to the ECU 84. The compressor-inflow-gas temperature sensor 86 detects the temperature of gas that flows into the compressor 80*a*, that is, a mixed gas of fresh air and EGR gas. The intake passage wall surface temperature sensor 88 detects the wall surface temperature of the intake passage 12 between the compressor inlet portion 20*a*2 and a connecting portion with the EGR passage 30. The pocket wall surface temperature sensor 90 detects the wall surface temperature of the collecting pocket 50.

As mentioned in the foregoing with respect to Embodiment 1, condensed water collected in the collecting pocket 50 can be evaporated by heating the collecting pocket 50 utilizing the heat of the scroll portion 20*a*5. On the other hand, the temperature of the compressor housing 20*a*1 and the bearing housing 20*d* is raised to a high temperature by compressed gas, and when the temperature of the diffuser portion 20*a*6 also increases as a result, deposits are liable to build up on the wall surface of the diffuser portion 20*a*6.

If cooling of the diffuser portion 20*a*6 is constantly performed utilizing the cooling water passage 80*a*1 or the like to suppress the buildup of deposits in the diffuser portion 20*a*6, a situation can arise in which the transfer of heat to the collecting pocket 50 from the scroll portion 20*a*5 is inhibited. Therefore, according to the present embodiment, in order to compatibly realize the two functions of heating the collecting pocket 50 utilizing heat received from the scroll portion 20*a*5, and cooling the diffuser portion 20*a*6, a configuration is adopted so as to adjust the cooling water flow rate inside the first cooling water passage 80*a*1. More specifically, in a situation in which condensed water is generated in the intake passage 12 on the downstream side of the EGR passage 30, if the wall surface temperature of the collecting pocket 50 is equal to or less than a predetermined value (preferably, a boiling temperature $T_{BP}$ of the condensed water), the cooling water flow rate inside the first cooling water passage 80*a*1 is restricted.

Figure 6:
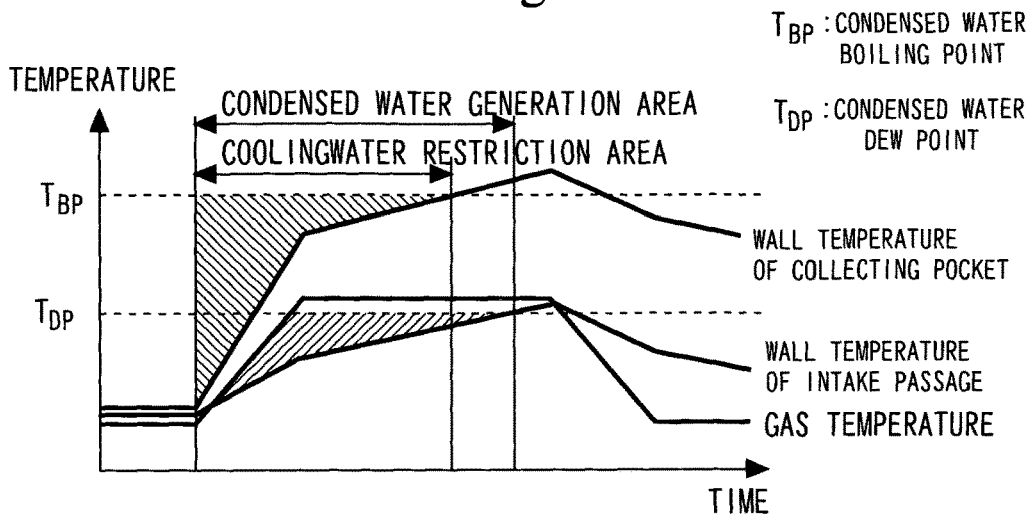
FIG. 6 is a view for describing a condensed water generation area and a cooling water restriction area in an operating region in which introduction of EGR gas is performed.

FIG. 6 is a view for describing a condensed water generation area and a cooling water restriction area in an operating region in which introduction of EGR gas is performed. As shown as a "condensed water generation area" in FIG. 6, under circumstances in which the temperature of gas that flows into the compressor 80*a* is higher than the wall surface temperature of the intake passage 12 (temperature of inner wall 12*a*), if the wall surface temperature of the intake passage 12 becomes less than or equal to a dew point $T_{DP}$ of the condensed water, condensed water is generated when gas contacts the inner wall 12*a*. On the other hand, if the wall surface temperature of the collecting pocket 50 is less than or equal to the boiling temperature $T_{BP}$ of the condensed water, condensed water is no longer evaporated within the collecting pocket 50. Accordingly, in a "cooling water restriction area" shown in FIG. 6, it is necessary to restrict the flow rate of cooling water.

Figure 7:
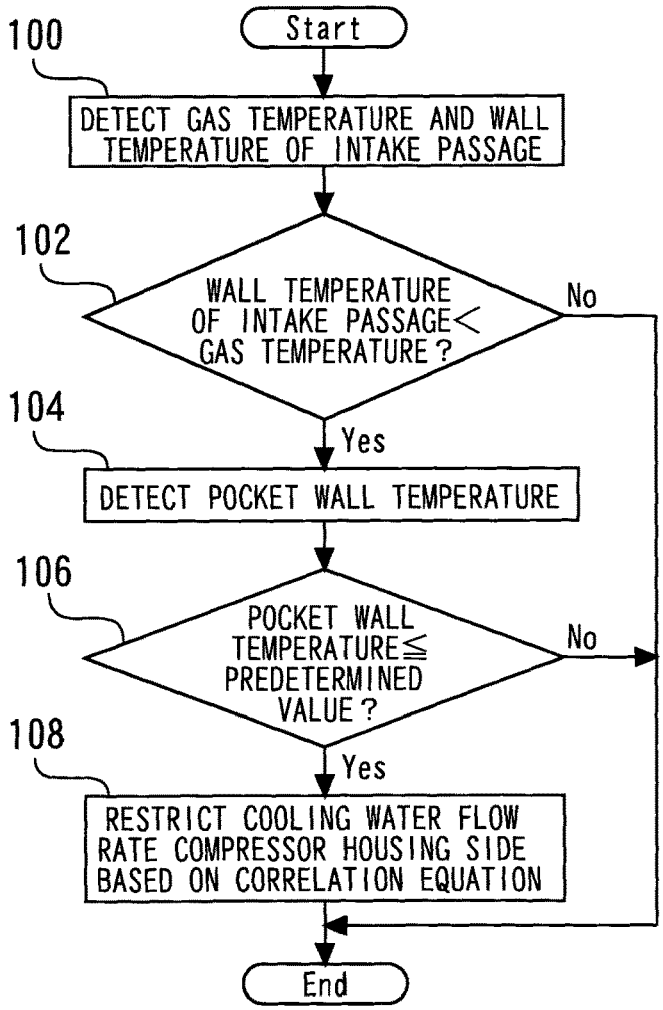
FIG. 7 is a flowchart illustrating a control routine that is executed in Embodiment 2 of the present invention.

FIG. 7 is a flowchart illustrating a control routine that the ECU 84 executes to realize characteristic control according to Embodiment 2 of the present invention. Note that, it is assumed that the present routine is repeatedly executed for each predetermined control period.

According to the routine shown in FIG. 7, first, using the compressor-inflow-gas temperature sensor 86 and the intake passage wall surface temperature sensor 88, the ECU 84 detects the temperature of gas that flows into the compressor 80*a* and the wall surface temperature of the intake passage 12 (temperature of inner wall 12*a*) (step 100). Note that these temperatures may also be acquired based on a predetermined estimation technique without using the aforementioned sensors. That is, the gas temperature can be estimated based on, for example, the EGR gas amount and the fresh air amount. Further, the intake passage wall surface temperature can be estimated based on, for example, the outside air temperature, the EGR gas amount, the load factor, the engine speed (i.e. engine revolution speed) and the operating history.

Next, to determine whether or not the situation is one in which condensed water is being generated in the intake passage 12 on the downstream side of the EGR passage 30, the ECU 84 determines whether or not the temperature of the wall surface of the intake passage is lower than the gas temperature (step 102). Note that, apart from the technique in the present step 102, this determination may also be performed, for example, based on whether or not the temperature of the wall surface of the intake passage is less or equal to the dew point $T_{DP}$ of the condensed water.

If the result determined in step 102 is affirmative, that is, if it can be determined that the situation is one in which condensed water is being generated in the intake passage 12 on the downstream side of the EGR passage 30, next, the ECU 84 detects the wall surface temperature of the collecting pocket 50 using the pocket wall surface temperature sensor 90 (step 104). Note that, this temperature may also be acquired based on a predetermined estimation technique without using a sensor. That is, the temperature of the pocket wall surface can be estimated based on, for example, the outside air temperature, the EGR gas amount, the load factor, the engine speed (i.e. engine revolution speed) and the operating history.

Next, the ECU 84 determines whether or not the pocket wall surface temperature is equal to or less than a predetermined value (step 106). Here, as one preferable example, the predetermined value is set to a value that is based on the boiling temperature $T_{BP}$ of the condensed water. Note that, the boiling temperature $T_{BP}$ of the condensed water is a temperature that takes into account components that are included in EGR gas, and not only water.

If the result determined in step 106 is affirmative, the ECU 84 restricts the cooling water flow rate inside the first cooling water passage 80*a*1 for cooling the compressor housing 20*a*1 (step 108). More specifically, a cooling water flow rate $Q_w$ is determined based on the correlation shown in the following equation (1).

[Formula 1]

$$Q_w = f(T_{C/hsg}, T_w) \quad (1)$$

Where, in the above equation (1), $T_{C/hsg}$ represents the wall surface temperature of the collecting pocket 50, and $T_w$ represents the cooling water temperature.

In the present step 108, in accordance with the above equation (1), the lower that the pocket wall surface temperature $T_{C/hsg}$ is, the more that the cooling water flow rate $Q_w$ is decreased. Further, the lower that the cooling water temperature $T_w$ is, the more that the cooling water flow rate $Q_w$ is decreased. However, this control is based on the assumption that the situation is one in which the temperature of the compressor housing 20*a*1 is higher than the cooling water temperature $T_w$. If a situation is assumed in which, for example, the compressor housing 20*a*1 is being cooled by outside air under circumstances of a low outside air temperature, it is also possible that the temperature of the compressor housing 20*a*1 will be lower than the cooling water temperature $T_w$. Under such circumstances, rather than restricting the cooling water flow rate $Q_w$ as in the above described control, circulation of cooling water may be allowed so as to quickly warm the compressor housing 20*a*1 to promote heating of the collecting pocket 50. Accordingly, the above described control may be switched in accordance with whether or not the temperature of the compressor housing 20*a*1 is higher than the cooling water temperature $T_w$.

According to the routine illustrated in FIG. 7 that is described above, in a case where the wall surface temperature of the intake passage is lower than the gas temperature, and the pocket wall surface temperature is equal to or less than a predetermined value (boiling temperature $T_{BP}$ of the condensed water), the cooling water flow rate $Q_w$ inside the first cooling water passage 80*a*1 is restricted to a small flow rate. Thus, in a situation in which condensed water is being generated in the intake passage 12 on the downstream side of the EGR passage 30, a decrease in the pocket wall surface temperature can be suppressed. Accordingly, it is possible to suppress a decrease in the effect of a function for heating the collecting pocket 50 utilizing heat received from the scroll portion 20*a*5 can be suppressed, while also securing a function for cooling the diffuser portion 20*a*6 by circulation of cooling water.

In this connection, in the above described Embodiment 2, a configuration is adopted that, in a case where the wall surface temperature of the intake passage is lower than the gas temperature, and the pocket wall surface temperature is equal to or less than a predetermined value (boiling temperature $T_{BP}$ of the condensed water), the cooling water flow rate $Q_w$ inside the first cooling water passage 80*a*1 is restricted to a value that depends on the pocket wall surface temperature $T_{C/hsg}$ and the cooling water temperature $T_w$. However, the form of restricting the cooling water flow rate $Q_w$ in this case is not limited to the form described above and, for example, a form may be adopted that stops circulation of cooling water inside the first cooling water passage 80*a*1. A configuration may also be adopted that restricts the cooling water flow rate (including stopping the circulation) in the second cooling water passage 80*a*2 instead of in the first cooling water passage 80*a*1, or in addition thereto. However, adjustment of the cooling water flow rate $Q_w$ as a measure which takes into consideration the transfer of heat to the collecting pocket 50 is effective when performed with respect to the first cooling water passage 80*a*1 on the side that is close to the collecting pocket 50.

Further, in the above described Embodiment 2, to cool the diffuser portion 20*a*6, the first cooling water passage 80*a*1 is provided in the compressor housing 20*a*1 and the second cooling water passage 80*a*2 is provided in the bearing housing 20*d*. However, as long as a cooling water passage of the present invention is provided in a "housing that is included in a compressor", the cooling water passage may be provided, for example, in either one of the compressor housing 20*a*1 and the bearing housing 20*d*.

In the foregoing Embodiments 1 and 2, the turbo-supercharger 20 that utilizes exhaust energy as a driving force is described as an example of a supercharger that has the compressor 20*a* or 80*a*. However, a compressor according to the present invention is not limited to a compressor configured as a turbo-supercharger, and for example, the compressor may be one that is driven utilizing a motive force from a crankshaft of the internal combustion engine, or may be one that is driven by an electric motor.

REFERENCE SIGNS LIST

10 Internal combustion engine
12 Intake passage
12*a* Inner wall of intake passage
14 Exhaust Passage
16 Air cleaner
18 Air flow meter
20 Turbo-supercharger
20*a*, 80*a* Compressor
20*a*1 Compressor Housing
20*a*2 Compressor inlet portion
20*a*3 Compressor impeller
20*a*4 Impeller portion
20*a*5 Scroll portion
20*a*6 Diffuser portion
20*a*7 Compressor inlet
20*b* Turbine
20*c* Connecting shaft
20*d* Bearing housing
22 Intercooler
24 Throttle valve
26 Exhaust purification catalyst
28 EGR device
30 EGR passage
32 EGR cooler
34 EGR valve
40, 84 ECU (Electronic Control Unit)
42 Crank angle sensor
44 Cooling water temperature sensor

46 Fuel injection valve
48 Ignition device
50, 60, 70 Collecting pocket
50*a*, 60*a*, 70*a* Inner circumferential wall portion
50*a*1, 60*a*1, 70*a*1 Inside circumferential wall surface of inner circumferential wall portion
50*b*, 60*b*, 70*b* Outer circumferential wall portion
50*b*1, 60*b*1, 70*b*1 Inside circumferential wall surface of outer circumferential wall portion
50*c*, 60*c*, 70*c* Cell
52, 62, 72 Partition wall
80*a*1 First cooling water passage
80*a*2 Second cooling water passage
82 Flow rate adjusting valve
86 Compressor-inflow-gas temperature sensor
88 Intake passage wall surface temperature sensor
90 Pocket wall surface temperature sensor

The invention claimed is:

1. An internal combustion engine, comprising:
a compressor for supercharging intake air;
an EGR device for introducing EGR gas into an intake passage on an upstream side relative to the compressor; and
a collecting pocket being a ring shape surrounding an outer circumference of an inlet of the compressor and that includes at least one partition walls that divides the collecting pocket into a plurality of cells;
wherein the collecting pocket opens towards the upstream side of the compressor, and collects condensed water that is generated inside the intake passage on the upstream side relative to the compressor.

2. The internal combustion engine according to claim 1, wherein, in a circumferential wall surface that becomes a downward side in a gravitational direction among wall surfaces of a cell of the collecting pocket that is partitioned by the at least one partition wall, in comparison to an area on an inlet side of the collecting pocket, an area on an innermost side is located at a lower position in the gravitational direction.

3. The internal combustion engine according to claim 1, further comprising:
a cooling water passage through which cooling water flows that cools a housing that is included in the compressor; and
a flow rate adjusting device for adjusting a cooling water flow rate in the cooling water passage.

4. The internal combustion engine according to claim 3, wherein
the condensed water is generated in a downstream-side intake passage that is on a downstream side relative to a portion for introducing EGR gas by an EGR device in the intake passage;
a wall surface temperature of the collecting pocket is equal to or less than a predetermined value; and
the flow rate adjusting device is controlled to restrict the cooling water flow rate in the cooling water passage.

5. The internal combustion engine according to claim 4, wherein the predetermined value relating to the wall surface temperature of the collecting pocket is a boiling temperature of the condensed water that is generated in the downstream-side intake passage.

6. The internal combustion engine according to claim 1, wherein the at least one partition wall is formed inside the collecting pocket so as to extend radially from a center of the inlet of the compressor in a radial direction of the inlet.

7. The internal combustion engine according to claim 1, wherein the at least one partition wall is formed inside the collecting pocket so as to extend in a gravitational direction.

8. An internal combustion engine, comprising:
a compressor for supercharging intake air;
an EGR device for introducing EGR gas into an intake passage on an upstream side relative to the compressor; and
a collecting pocket being a ring shape surrounding an outer circumference of an inlet of the compressor, and that includes a plurality of cells which collect condensed water that is generated inside the intake passage on the upstream side relative to the compressor;
a cooling water passage through which cooling water flows that cools a housing that is included in the compressor; and
a flow rate adjusting device for adjusting a cooling water flow rate in the cooling water passage.

* * * * *